US006186805B1

(12) United States Patent
Krishnaswamy et al.

(10) Patent No.: US 6,186,805 B1
(45) Date of Patent: Feb. 13, 2001

(54) SHORT CIRCUIT ELECTRICAL CONNECTOR

(75) Inventors: Chandrasekar Krishnaswamy, Lisle; Kevin C. Benes, Willowbrook; David R. Kalal, Wheato; Kenneth Grambley, Elburn, all of IL (US)

(73) Assignee: Molex Incorporated, Lisle, IL (US)

( * ) Notice: Under 35 U.S.C. 154(b), the term of this patent shall be extended for 0 days.

(21) Appl. No.: 09/387,680

(22) Filed: Aug. 31, 1999

(51) Int. Cl.[7] ..... H01R 29/00
(52) U.S. Cl. ..... 439/188; 200/51.1
(58) Field of Search ..... 439/188, 189; 200/51.1

(56) References Cited

U.S. PATENT DOCUMENTS

| | | | |
|---|---|---|---|
| 4,850,888 | 7/1989 | Denlinger et al. | 439/188 |
| 5,263,872 | 11/1993 | Marpoe, Jr. et al. | 439/188 |
| 5,334,025 | 8/1994 | Föhl | 439/188 |
| 5,466,168 | 11/1995 | Liebich et al. | 439/188 |
| 5,470,243 * | 11/1995 | Bendorf | 439/188 |
| 5,494,450 | 2/1996 | Kirsch et al. | 439/188 |
| 5,509,817 | 4/1996 | Tsuji | 439/188 |
| 5,674,084 | 10/1997 | Fukamachi | 439/188 |
| 5,791,922 * | 8/1998 | Takata et al. | 439/188 |
| 6,039,589 * | 3/2000 | LaLange et al. | 439/188 |

* cited by examiner

*Primary Examiner*—T. C. Patel

(57) ABSTRACT

A short circuit electrical connector includes an insulative housing having a front mating end with an opening for receiving a complementary mating connector. The opening communicates with an interior cavity. A plurality of terminals are mounted in the housing and have contact portions in the cavity for engaging appropriate terminals of the mating connector. A shorting member has a retention section for securing the shorting member in the housing near the opening. An inclined section extends rearwardly from the retention section into the cavity for engagement by the mating connector. A contact section extends from the inclined section remote from the retention section for engaging at least a pair of the terminals in the absence of the mating connector.

13 Claims, 5 Drawing Sheets

SHORT CIRCUIT ELECTRICAL CONNECTOR

FIELD OF THE INVENTION

This invention generally relates to the art of electrical connectors and, particularly, to a short circuit electrical connector such as might be used to prevent accidental firing of vehicular airbags.

BACKGROUND OF THE INVENTION

Short circuit electrical connectors are used in a variety of applications. One application is to protect against accidental firing of an electrical detonator which inflates a vehicular airbag. In particular, airbags are widely used for protecting passengers against the impact of a vehicular crash. An operating circuit for a typical airbag connects terminals to a detonator or igniter for a gas-generating device to terminals connected to a power source through an impact sensor. When the sensor detects a vehicular collision, current flows to the detonator to ignite the gas-generating device to produce a large amount of gas, thereby inflating the airbag.

Such detonators typically are connected to ignition voltage means by an electrical connector assembly. The connectors of the assembly can be unmated to allow the airbag and/or the detonator or other components to be removed for replacement, testing or the like. When the connectors are unmated, their is a risk that the detonator which is very sensitive will accidentally actuate whereby the airbag is unintentionally inflated. For instance, such an accidental inflation may result from leakage or other stray voltage, or accidentally applied current, energizing the ignition current supply of the detonator by electromagnetic induction. In other words, there always is a risk that a magnetic field or an electrical field may be created around the open terminals of the connectors which, in turn, could induce a voltage between the open connector terminals so that current could flow to the igniter or detonator of the airbag.

In order to prevent unintentional actuation of airbags, short circuit electrical connectors are used to maintain the connector terminals closed so that current may not accidentally flow into the operating system when the mating connectors of the connector assembly are not fully mated. Unfortunately, many such connectors have been unnecessarily complicated, not sufficiently reliable and not cost effective. The present invention is directed to providing a very simple, reliable and inexpensive short circuit system in an electrical connector assembly.

SUMMARY OF THE INVENTION

An object, therefore, of the invention is to provide a new and improved short circuit electrical connector of the character described.

Another object of the invention is to provide a new and improved short circuit electrical connector assembly which includes a pair of mating connectors.

In the exemplary embodiment of the invention, a short circuit electrical connector is provided with an insulative housing having a mating end with an opening for receiving a complementary mating connector. The opening communicates with an interior cavity. A plurality of terminals are mounted in the housing and have contact portions in the cavity for engaging appropriate terminals of the mating connector. A shorting member has a retention section for securing the member in the housing near the opening. An inclined section of the shorting member extends rearwardly from the retention section into the cavity for engagement by the mating connector. A contact section extends from the inclined section remote from the retention section for engaging at least a pair of the terminals in the absence of the mating connector.

As disclosed herein, the terminals have contact pin portions extending into the cavity. The inclined section of the shorting member is bifurcated to define a pair of resilient beams terminating in contact portions for engaging the pair of terminals. The housing includes a latch member for engaging an appropriate latch means of the mating connector. The bottom of the cavity in the housing is defined by a bottom wall of varying thickness for polarizing purposes.

The invention contemplates a short circuit electrical connector assembly including the connector described above, along with a second or mating connector which includes a housing having an engagement member for engaging the inclined section of the shorting member of the first connector. The engagement member of the second connector is formed by a block molded integrally with the housing and extending transversely of a mating plug of the second connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
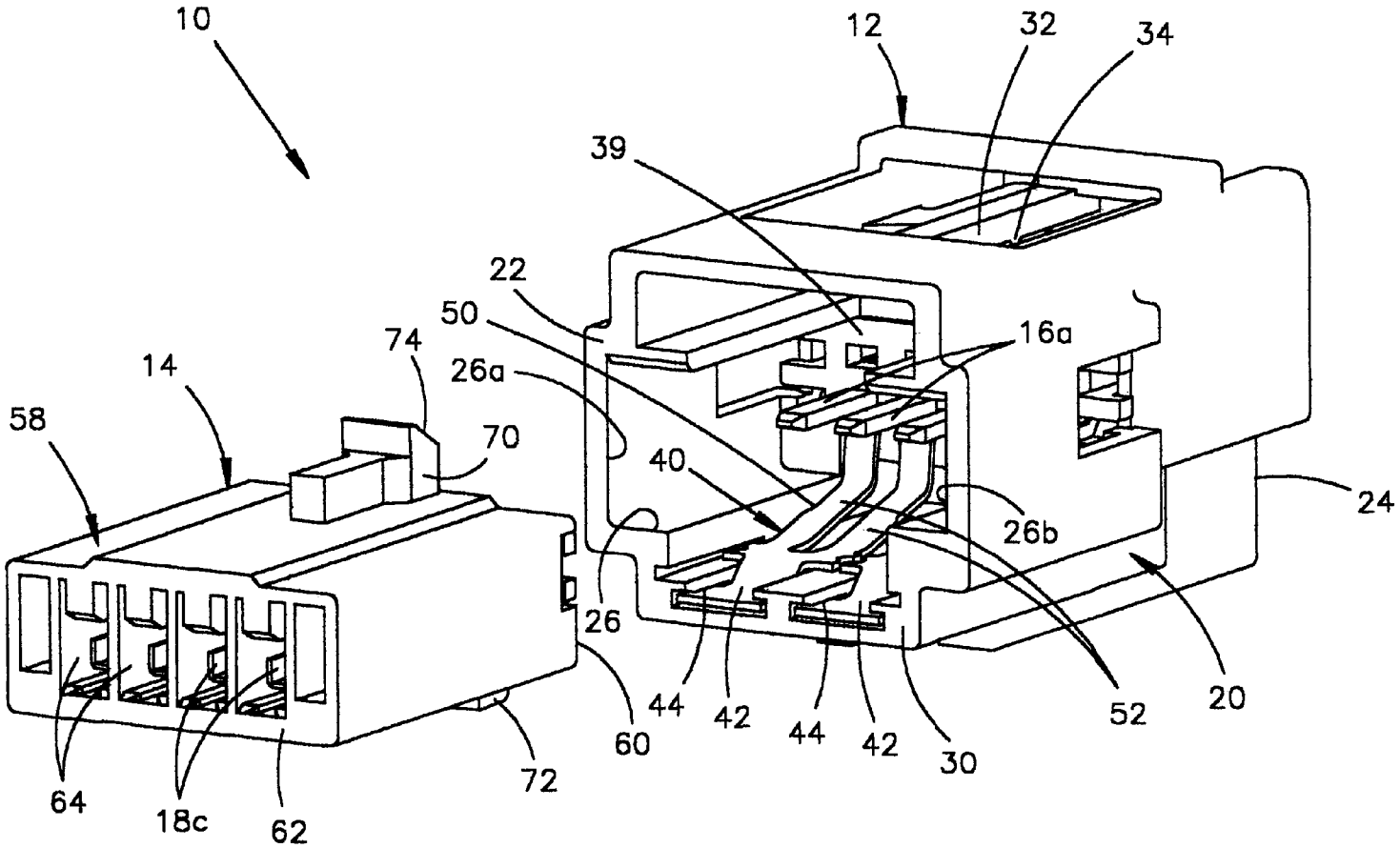
FIG. 1 is a perspective view of a short circuit electrical connector assembly embodying the concepts of the invention.
Figure 2:
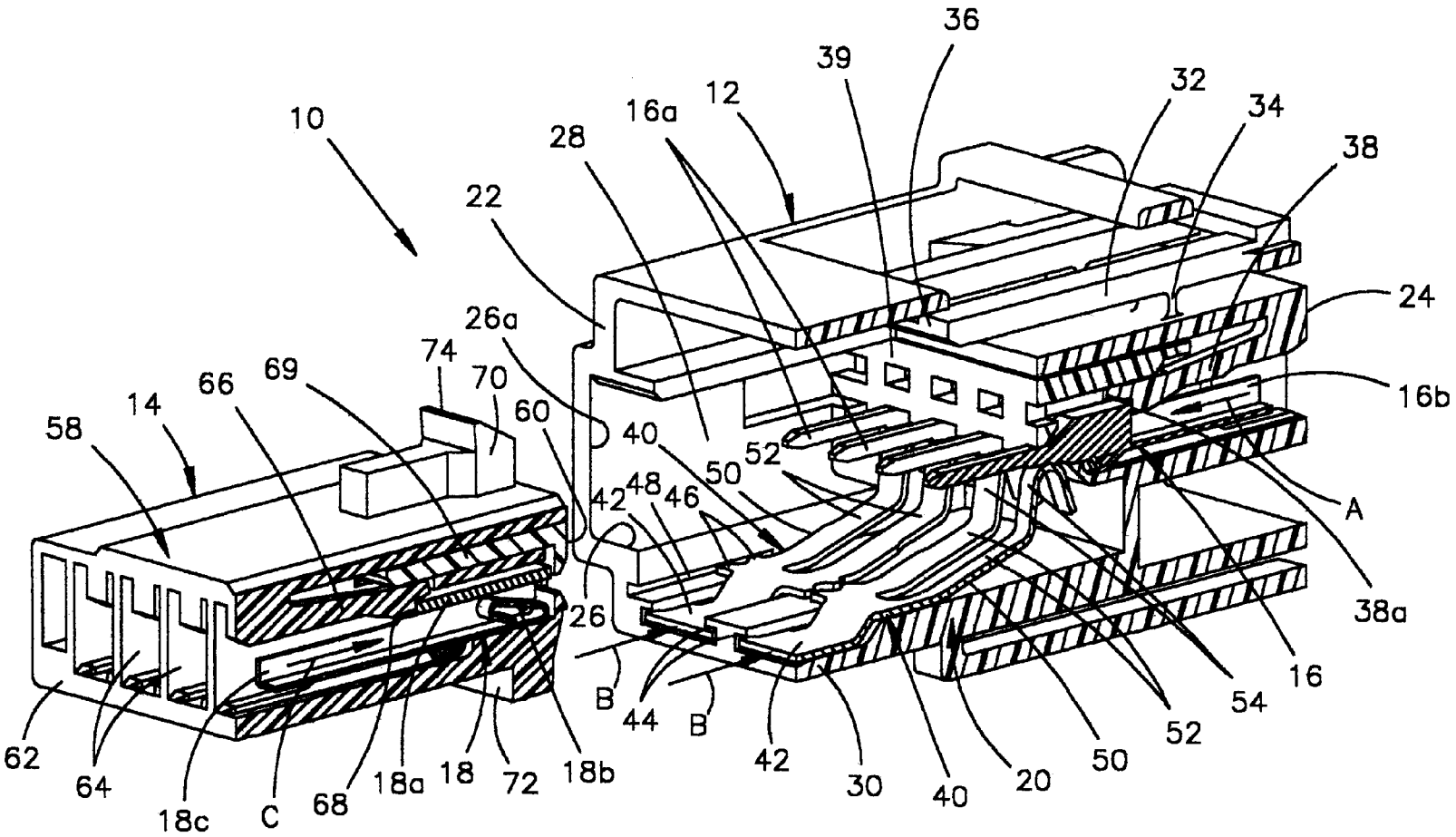
FIG. 2 is a front-to-rear section through the connector assembly as depicted in FIG. 1.

Referring to the drawings in greater detail, and first to FIGS. 1 and 2, the invention is embodied in an electrical connector assembly, generally designated 10, which includes a first or receptacle connector, generally designated 12, and a second or plug connector, generally designated 14. Receptacle connector 12 mounts a plurality of male or pin terminals, generally designated 16 (FIG. 2), which mate with a plurality of female terminals, generally designated 18, of plug connector 14.

More particularly, receptacle connector 12 includes an insulative housing, generally designated 20, which includes a front mating end 22 and a rear terminating end 24. The front mating end has an opening 26 communicating with an interior cavity 28. The cavity is defined in part by a bottom wall 30 of the housing. A cantilever-type latch arm 32 is pivoted to housing 20 at 34 and includes a front latch bridge 36. The housing is molded of dielectric material such as plastic or the like, and latch arm 32 is pivoted by a living hinge at 34 molded integrally with the housing. Terminals 16 are inserted into rear terminating end 24 of the housing in the direction of arrow "A", and a flexible locking arm 38 is provided for each terminal. The locking arm has a lock shoulder 38*a* to prevent the respective terminal from backing out of the housing. Each pin terminal 16 (FIG. 2) includes a contact pin portion 16*a* projecting forwardly into interior cavity 28 of housing 20. A rear terminating end 16*b* of each pin terminal is connected to an appropriate electrical wire or conductor (not shown). To facilitate molding housing 20, a separate plastic insert 39 is used to hold terminals 16 in the housing.

A plurality of shorting members, generally designated 40, are mounted within housing 20 of receptacle connector 12, primarily within interior cavity 28 of the housing. Each shorting member includes a retention section 42 secured within a slot 44 at front mating end 22 of housing 20, at opening 26. Guide prongs 46 of the shorting members ride in guide slots 48 of the housing. Guide prongs 46 comprise remaining portions of the carrier strip (not shown) for the shorting members 40 severed at pilot holes thereof. An inclined section 50 of each shorting member extends rearwardly from the respective retention section 42 into cavity 28. The inclined section is bifurcated to define a pair of resilient beams 52 which are angled upwardly and terminate in a pair of rounded contact portions 54 which define a contact section of each shorting member 40. Each shorting member is stamped and formed of conductive sheet metal material, whereby beams 52 of inclined section 50 are resiliently effective to bias contact portions 54 into engagement with the underside of a pair of pin terminals 16 when plug connector 14 is not mated with receptacle connector 12. Therefore, each shorting member 40 is effective to short a pair of the pin terminals.

Plug connector 14 of connector assembly 10 includes an insulative housing, generally designated 58. The housing has a front mating plug end 60 and a rear terminating end 62. Each female terminal 18 is inserted through an opening 64 at the rear of housing 58 in the direction of arrow "C" (FIG. 2). Like receptacle connector 12, a locking arm 66 having a lock shoulder 68 prevents each respective female terminal 18 from backing out of the housing. Each female terminal 18 includes a fairly rigid top plate 18*a* spaced from a spring contact portion 18*b*. A rear terminating end 18*c* of each terminal is terminated to an electrical wire or other appropriate conductor. To facilitate molding housing 58, a separate plastic insert 69 is used to hold terminals 18 in the housing.

Still referring to plug connector 14, a latch boss 70 projects upwardly from housing 58, and an engagement member 72 projects downwardly from the housing. The latch boss has an angled or chamfered front top surface 74. Engagement member 72 is in the form of a block which extends transversely across mating plug 60 of plug connector 14. Housing 58 is molded of dielectric material such as plastic or the like, and latch boss 70 and engagement block 72 are molded integrally therewith.

Figure 3:
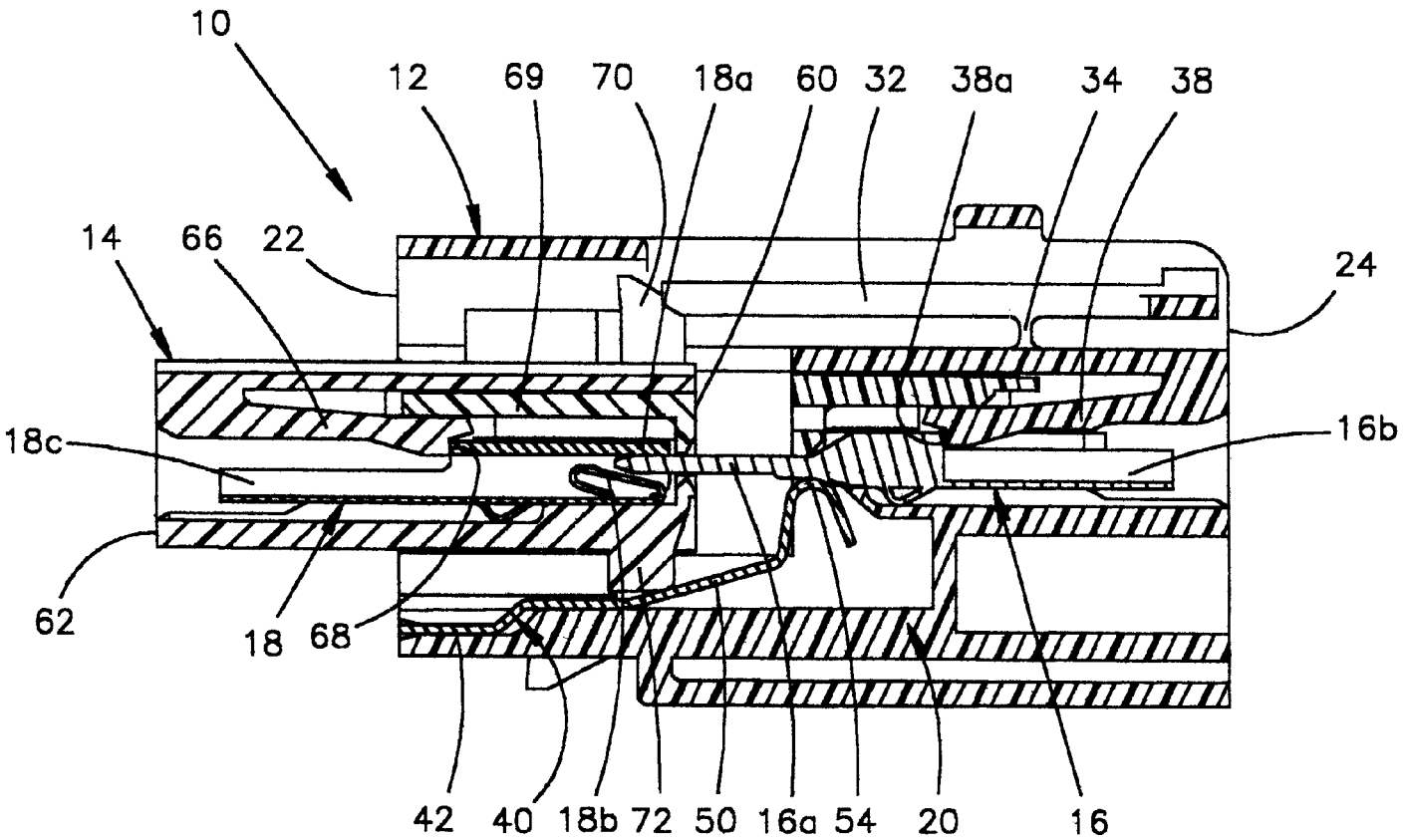
FIG. 3 is a section through the connector assembly, with the connectors only partially mated.

FIG. 3 shows plug connector 14 of connector assembly 10 only partially inserted into receptacle connector 12. However, it can be seen that contact pin portions 16*a* of pin terminals 16 have engaged top plates 18*a* of female terminals 18. While engagement block 72 of the plug connector has come into engagement with inclined sections 50 of shorting members 40, contact sections 54 of the shorting members still are in engagement with pin terminals 16. Therefore, pin terminals 16 of receptacle connector 12 and female terminals 18 of plug connector 14 establish contact before shorting members 40 are disengaged from their shorting conditions in contact with the pin terminals.

Figure 4:
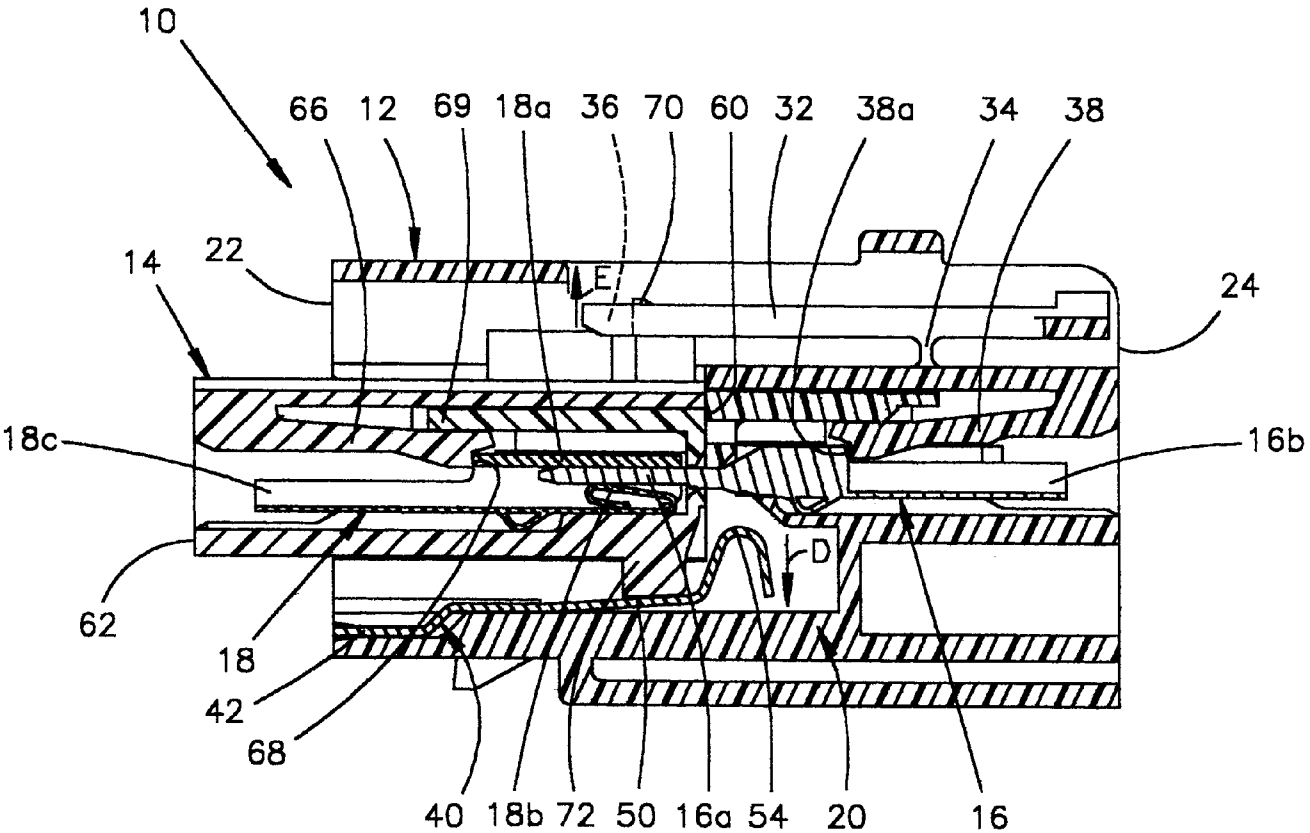
FIG. 4 is a section through the connector assembly, with the connectors fully mated.

FIG. 4 shows plug connector 14 of connector assembly 10 fully mated with receptacle connector 12. Contact pin portions 16*a* of pin terminals 16 now are fully inserted between top plates 18*a* and spring contact portions 18*b* of female terminals 18. Engagement block 72 of the plug connector now has pushed downwardly on inclined sections 50 of shorting members 40 to move contact sections 54 downwardly in the direction of arrow "D" out of engagement with pin terminals 16. Latch boss 70 of the plug connector also has snapped into latching position behind latch bridge 36 of latch arm 32 of receptacle connector 12 to hold the connectors in mated condition.

If it is desired to unmate the connectors, latch arm 32 is raised in the direction of arrow "E" (FIG. 4) so that latch boss 70 clears latch bridge 36, whereupon the connectors can be unmated. When the connectors are unmated, contact sections 54 of shorting members 40 will move back upwardly opposite the direction of arrow "D" into engagement with pin terminals 16 before contact pin portions 16*a* of the pin terminals disengage from top plates 18*a* of female terminals 18 of plug connector 14.

Figure 5:
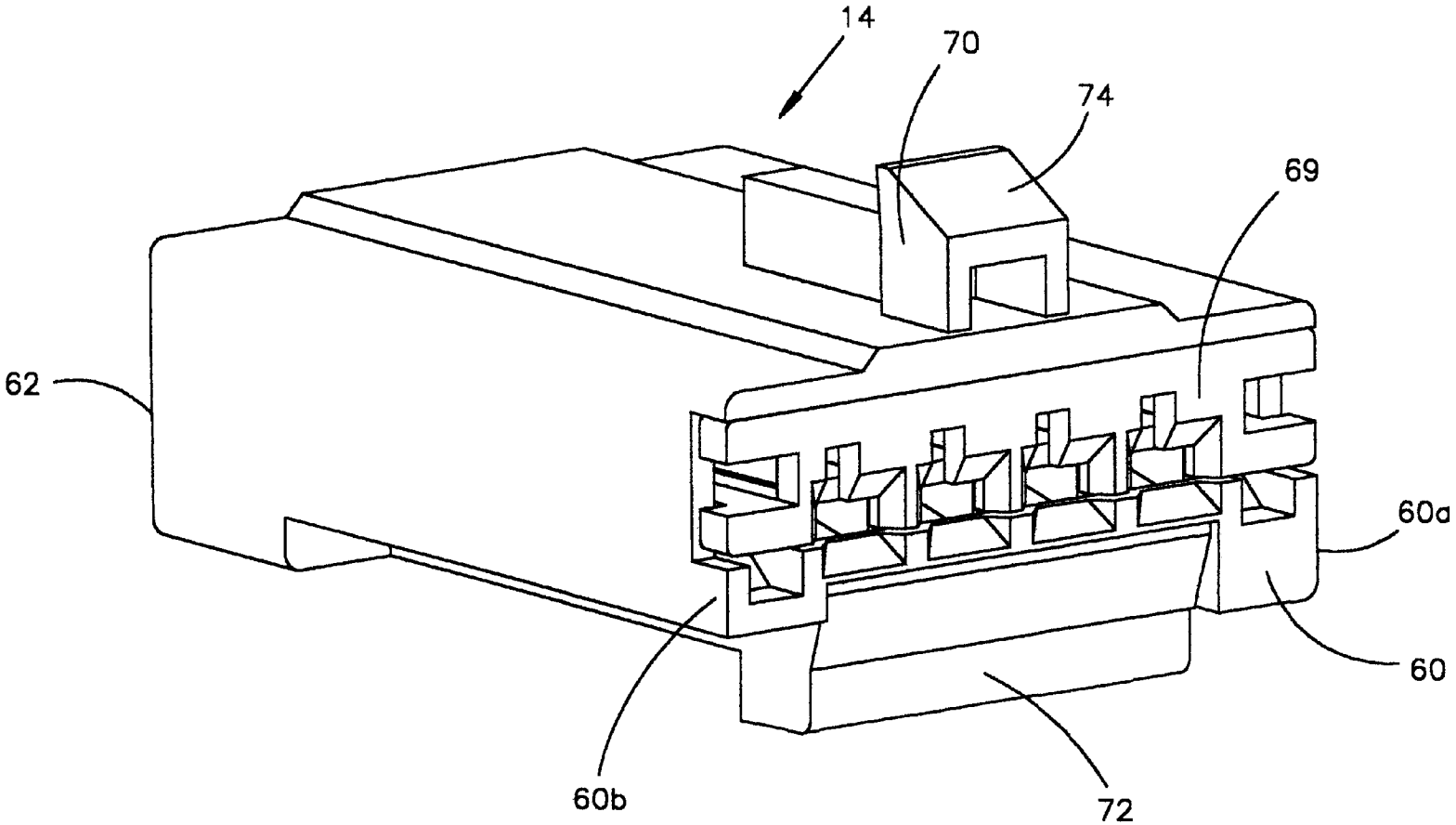
FIG. 5 is a perspective view of the mating end of the plug connector.

Receptacle connector 12 and plug connector 14 are polarized so that the plug connector can be mated with the receptacle connecter in only one orientation. More particularly, FIG. 1 shows that bottom wall 30 of housing 20 of receptacle connector 12 has varying thicknesses to define a long side 26*a* of opening 26 and a short side 26*b* of the opening. As seen in FIG. 5, mating end 60 of plug connector 14 has a long side 60*a* and a short side 60*b* corresponding to long and short sides 26*a* and 26*b*, respectively, of opening 26 at mating end 22 of receptacle connector 12. Therefore, the plug connector can be mated with the receptacle connector only when these respective long and short sides are in alignment.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A short circuit electrical connector, comprising:

an insulative housing having a front mating end with an opening for receiving a complementary mating connector, the opening communicating with an interior cavity, and a slot in the front mating end at an edge of the opening;

a plurality of terminals mounted in the housing and having contact portions in the cavity for engaging appropriate terminals of the mating connector; and a shorting member having a retention section extending rearwardly from the mating end of the housing and insertable into said slot for securing the member in the housing near said opening, an inclined section extending rearwardly from a rear edge of the retention section into the cavity for engagement by the mating connector, and a contact section extending from the inclined section remote from the retention section for engaging at least a pair of the terminals in the absence of the mating connector.

2. The short circuit electrical connector of claim 1 wherein said terminals in the housing have contact pin portions extending into the cavity.

3. The short circuit electrical connector of claim 1 wherein said inclined section of the shorting member is bifurcated to define a pair of resilient beams terminating in contact portions for engaging the pair of terminals.

4. The short circuit electrical connector of claim 1 wherein said housing includes a latch member for engaging an appropriate latch means of the mating connector.

5. The short circuit electrical connector of claim 1 wherein the bottom of the cavity in said housing is defined by a bottom wall of varying thickness for polarization purposes.

6. A short circuit electrical connector assembly, comprising:

a first connector including an insulative housing having a front mating end with an opening communicating with an interior cavity, and a slot in the front mating end at an edge of the opening, a plurality of terminals mounted in the housing and having contact portions in the cavity thereof, and a shorting member having a retention section extending rearwardly from the mating end of the housing and insertable into said slot for securing the member in the housing near said opening, an inclined section extending rearwardly from a rear edge of the retention section into the cavity, and a contact section extending from the inclined section remote from the retention section, a front edge of the retention section being in-line with the inclined section; and a second connector for mating with the first connector and including an insulative housing having a mating plug end for insertion through the opening and into the cavity of the first connector, a plurality of terminals having contact portions for engaging the contact portions of the terminals of the first connector, and an engagement member for engaging the inclined section of said shorting member to move the contact section of the shorting member out of engagement with said pair of terminals when the two connectors are fully mated.

7. The short circuit electrical connector assembly of claim 6 wherein said engagement member and shorting member are located relative to the locations of the terminals of the respective connectors so that the contact portions of the terminals engage before the contact section of the shorting member is moved out of engagement with the pair of terminals.

8. The short circuit electrical connector assembly of claim 6 wherein said engagement member is integral with the housing of the second connector.

9. The short circuit electrical connector assembly of claim 8 wherein said engagement member comprises a block extending transversely of the mating plug of the second connector.

10. The short circuit electrical connector assembly of claim 6 wherein the terminals of said first connector have contact pin portions extending into the cavity.

11. The short circuit electrical connector assembly of claim 6 wherein said inclined section of the shorting member is bifurcated to define a pair of resilient beams terminating in contact portions for engaging the pair of terminals.

12. The short circuit electrical connector assembly of claim 6 wherein the housings of said first and second connectors include complementary interengaging latch means to hold the connectors in mated condition.

13. The short circuit electrical connector assembly of claim 6 wherein the bottom of the cavity in the housing of said first connector is defined by a bottom wall of varying thickness for polarization purposes.

* * * * *